US010533360B2

(12) United States Patent
Goodman et al.

(10) Patent No.: US 10,533,360 B2
(45) **Date of Patent: *Jan. 14, 2020**

(54) SYSTEMS AND METHODS FOR MONITORING AUTOMATIC DOORS

(71) Applicant: Won-Door Corporation, Salt Lake City, UT (US)

(72) Inventors: E. Carl Goodman, Salt Lake City, UT (US); Duane O. Hall, Sandy, UT (US)

(73) Assignee: Won-Door Corporation, Salt Lake City, UT (US)

( * ) Notice: Subject to any disclaimer, the term of this patent is extended or adjusted under 35 U.S.C. 154(b) by 294 days.

This patent is subject to a terminal disclaimer.

(21) Appl. No.: 15/445,783

(22) Filed: Feb. 28, 2017

(65) Prior Publication Data

US 2017/0167176 A1 Jun. 15, 2017

Related U.S. Application Data

(62) Division of application No. 13/009,236, filed on Jan. 19, 2011, now Pat. No. 9,580,957.

(51) Int. Cl.
*E05F 15/00* (2015.01)
*E06B 9/68* (2006.01)
(Continued)

(52) U.S. Cl.
CPC ..... *E05F 15/00* (2013.01); *E06B 3/481* (2013.01); *E06B 9/68* (2013.01); *G08B 21/18* (2013.01);
(Continued)

(58) Field of Classification Search
CPC ..... E05F 15/00
See application file for complete search history.

(56) References Cited

U.S. PATENT DOCUMENTS 6,310,548 B1 10/2001 Stephens et al.
6,481,156 B1 11/2002 Richmond
(Continued)

FOREIGN PATENT DOCUMENTS

KR 637869 10/2006

*Primary Examiner* — Catherine A Kelly
(74) *Attorney, Agent, or Firm* — TraskBritt

(57) ABSTRACT

Monitoring systems for automatic doors comprise at least one input device configured for sensing at least one characteristic of at least one operational parameter of an automatic door system, a door system controller coupled to the at least one input device, at least one monitor display comprising a first interface operatively coupled to the door system controller, and at least another interface operatively coupled to the at least one monitor display and configured to be operatively coupled to at least one remote display device. The at least one monitor display is configured to continuously request information representative of the at least one operational parameter characteristic from the door system controller and display the information. Methods of monitoring an automatic door system comprise transmitting data representative of an operational parameter characteristic from an input device to at least one door system controller; sending a description of the operational parameter to a monitor display continuously; and displaying indicia representative of the description of the operational parameter.

19 Claims, 9 Drawing Sheets

(51) Int. Cl.
*E06B 3/48* (2006.01)
*G08B 21/18* (2006.01)

(52) U.S. Cl.
CPC ..... *E05Y 2400/415* (2013.01); *E05Y 2400/80* (2013.01); *E05Y 2400/82* (2013.01); *E05Y 2800/00* (2013.01); *E05Y 2800/21* (2013.01); *E05Y 2900/00* (2013.01); *E05Y 2900/106* (2013.01); *E05Y 2900/142* (2013.01); *E06B 2009/6836* (2013.01); *Y10T 29/49826* (2015.01)

(56) References Cited

U.S. PATENT DOCUMENTS

| | | | | |
|---|---|---|---|---|
| 6,798,342 | B2 * | 9/2004 | Addy | G08B 25/008 340/12.54 |
| 7,066,297 | B2 * | 6/2006 | Goodman | E05D 15/26 160/84.02 |
| 7,181,369 | B2 * | 2/2007 | Kanki | G05B 23/0243 702/182 |
| 7,737,860 | B2 * | 6/2010 | Banta | E06B 9/68 318/466 |
| 7,880,634 | B2 | 2/2011 | Fuller et al. | |
| 8,134,474 | B2 | 3/2012 | Fuller et al. | |
| 8,248,425 | B2 | 8/2012 | Ghosh | |
| 9,580,957 | B2 * | 2/2017 | Goodman | E06B 9/68 |
| 2006/0101721 | A1 | 5/2006 | Weik, III et al. | |
| 2008/0037579 | A1 | 2/2008 | Lee et al. | |
| 2012/0060103 | A1 | 3/2012 | Arasaki et al. | |
| 2012/0140750 | A1 | 6/2012 | Yan et al. | |
| 2012/0317276 | A1 | 12/2012 | Muniraju | |

* cited by examiner

SYSTEMS AND METHODS FOR MONITORING AUTOMATIC DOORS

CROSS-REFERENCE TO RELATED APPLICATION

This application is a divisional of U.S. patent application Ser. No. 13/009,236, filed Jan. 19, 2011, now U.S. Pat. No. 9,580,957, issued Feb. 28, 2017, the disclosure of which is hereby incorporated herein in its entirety by this reference.

TECHNICAL FIELD

Embodiments of the present disclosure relate generally to monitoring automated systems, and, more particularly, to monitoring automated doors and networks of automated doors.

BACKGROUND

Automatic doors are frequently used for security and safety purposes and may be implemented in various configurations, such as sliding doors, rotating panel doors, folding doors, or revolving doors. For example, referring to FIGS. 1 and 2, one example of an automatic door system 100 includes one or more accordion-type doors 102A/102B and may be used for security and/or safety purposes. Doors 102A/102B may be formed with a plurality of panels 104 connected to one another with hinges or hinge-like members 106. Hinges 106 may allow for doors 102A/102B to be folded and compactly stored in a pocket 108 formed within walls 110. Furthermore, doors 102A/102B may be driven by a motor 114 along a track 116 to join with one another in order to provide an appropriate barrier to secure an area.

The automatic door system 100 may further include input devices such as sensors and switches (not specifically shown), which may assist in the control and operation of doors 102A/102B. The input devices may be coupled to, and in communication with, an automatic door system controller or control box 118. For example, automatic door system 100 may include a sensor for determining whether AC power is being supplied to control box 118. In another example, automatic door system 100 may include a sensor for determining whether a back-up battery contains an adequate charge to provide power to a motor 114 in the event that there is a loss of AC power. Automatic door system 100 may also include a leading edge sensor for detecting an obstruction in the door's path when the door is being closed. Furthermore, the automatic door system 100 may include what is known as "panic hardware" or a device, which allows a predetermined amount of time during which a trapped person may escape through doors 102A/102B.

The failure of one or more components of automatic door system 100 (e.g., a battery pack, a power supply, or one or more input devices) may cause a system malfunction at a critical moment. Therefore, in order to ensure proper operation of automatic door system 100, a monitoring system may be integrated within control box 118. In the instance that an input device reports a malfunction or an emergency event, the monitoring system may report the malfunction or other event to an end-user. Because control box 118 is conventionally located inside pocket 108 for protection and security reasons, the monitoring system may be difficult to access in order to obtain information regarding a fault or alarm condition.

Some monitoring systems, due to difficulty in physically accessing such systems, utilize audio devices to identify faults and/or alarms. Although these monitoring systems are capable of providing fault or alarm data to the end-user, the data is typically difficult to decipher because each fault or alarm is conventionally designated by a different series of beeps. For example, a "one-one-three" beep pattern (a single distinct beep, followed by another single distinct beep, followed by three closely spaced beeps) may indicate that a battery has a low charge while a "one-two-one" beep pattern may indicate low AC voltage. When a user hears a series of beeps, the user must often turn to an owner's manual or contact a supplier or a maintenance company to determine which fault or alarm is being described by the series of beeps and then determine the necessary steps to repair or to further diagnose the problem.

In some instances, rather than relying on a series of beeps or other audible signals to provide information regarding the operation of a door, monitoring systems have been developed wherein fault and alarm data is provided in visual form. U.S. Pat. No. 7,737,860, to Banta et al., for example, discloses a system for monitoring automatic doors. The system for monitoring automatic doors includes a door, an input device, a door system controller, a remote display device, and a monitor display. The monitor display is configured to switch automatically from a master configuration to a slave configuration when the remote display device is operatively coupled to the door system controller.

When such a monitoring system is used in connection with an array of doors, the master/slave configuration may introduce lag into the system. For example, as the system determines the status of each door in a large array, such as up to 256 doors in an array, the information displayed locally on the monitor display for each door may only be updated once every three to six seconds (3-6 s) because each monitor display operating in a slave mode only receives updates from a respective door system controller when the remote display device operating in a master mode requests updated information from the respective door system controller of each door in the array. As automatic door systems may be capable of travelling at approximately thirty inches (30 in) every three seconds (3 s), an observer may not be able to rely upon the door status displayed locally on the monitor display because the door may have travelled up to five feet (5 ft) before the monitor display reflects the change in door status.

BRIEF SUMMARY

In some embodiments, the present disclosure includes monitoring systems for automatic doors, comprising at least one input device, a door system controller coupled to the at least one input device, at least one monitor display comprising a first interface operatively coupled to the door system controller, and at least another interface operatively coupled to the monitor display and configured to be operatively coupled to at least one remote display device. The at least one input device is configured to sense at least one characteristic of at least one operational parameter of an automatic door system and output a signal representative thereof. The door system controller is configured to receive the signal. The at least one monitor display is configured to substantially continuously request information representative of the at least one operational parameter characteristic from the door system controller and display the information. The at least one remote display device is configured to request information representative of the at least one operational parameter characteristic from the at least one monitor display when the at least one remote display device is operatively coupled to the at least another interface.

In other embodiments, the present disclosure includes networks of automatic door systems, comprising at least one communication line and a plurality of automatic door systems operatively coupled to the at least one communication line. At least one automatic door system of the plurality of automatic door systems comprises at least one input device configured for determining at least one operational parameter characteristic of the at least one automatic door system, a door system controller operatively coupled to the at least one input device and configured to request and receive a signal representative of the at least one characteristic of the at least one operational parameter from the at least one input device, and a monitor display operatively coupled to the door system controller and the at least one communication line and configured to request information representative of the at least one operational parameter from the door system controller substantially continuously.

In further embodiments, the present disclosure includes methods of monitoring an automatic door system, comprising transmitting a signal representative of a characteristic of an operational parameter from an input device to at least one door system controller; sending a description of the operational parameter characteristic to a monitor display continuously; and displaying indicia representative of the description of the operational parameter characteristic.

In still further embodiments, the present disclosure includes methods of installing an automatic door monitoring system, comprising coupling at least one input device configured for determining at least one characteristic of at least one operational parameter of an automatic door system to at least one input device interface of at least one door system controller; and coupling at least one monitor display configured to request data indicative of the at least one operational parameter substantially continuously to the at least one door system controller.

BRIEF DESCRIPTION OF THE DRAWINGS

While the specification concludes with claims particularly pointing out and distinctly claiming that which is regarded as the disclosure, various features and advantages of embodiments of this disclosure may be more readily ascertained from the following description of embodiments of the disclosure when read in conjunction with the accompanying drawings, in which:

DETAILED DESCRIPTION

Figure 1:
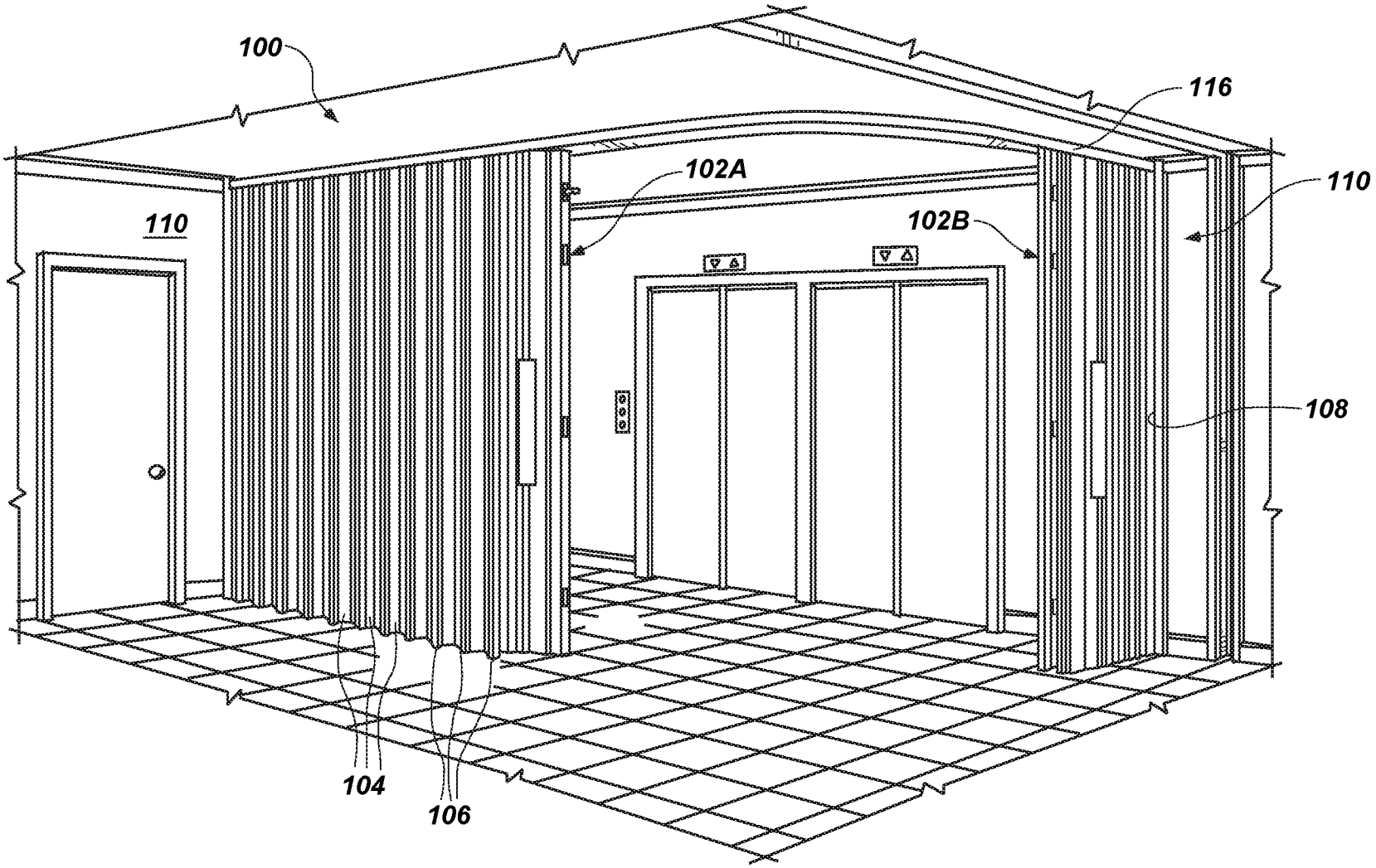
FIG. 1 (PRIOR ART)
FIG. 1 is an illustration of a prior art automatic door system.
Figure 2:
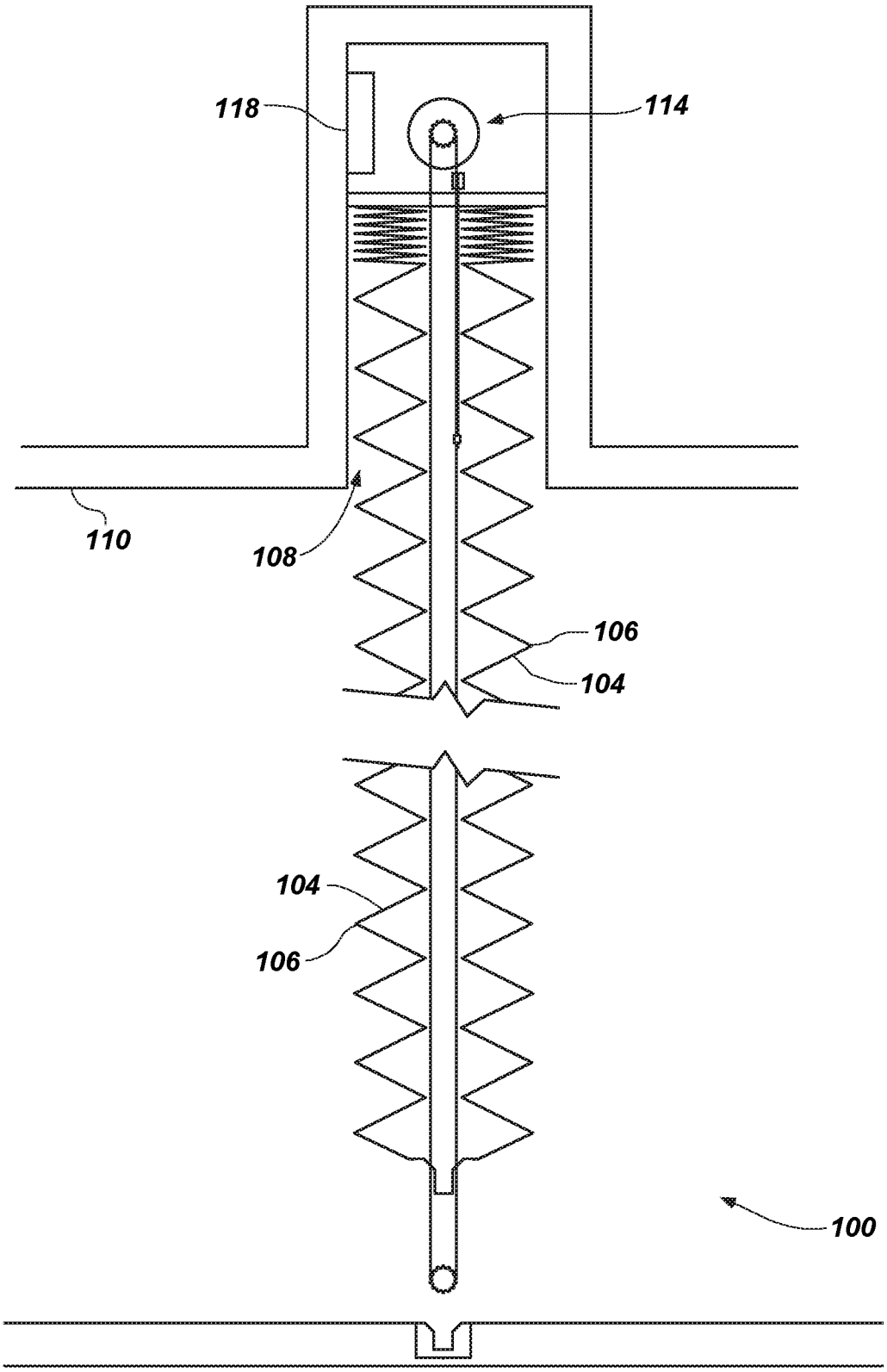
FIG. 2 (PRIOR ART)
FIG. 2 is a plan view of a prior art automatic door system.

Illustrations presented herein are not meant to be actual views of any particular device or system, but are merely idealized representations that are employed to describe embodiments of the present disclosure. Additionally, elements common between figures may retain the same numerical designation.

Various embodiments of the present disclosure may be implemented by hardware, software, firmware, middleware, microcode, or a combination thereof. When implemented in software, firmware, middleware, or microcode, the program code or code segments to perform the described tasks may be stored in a computer-readable medium such as a storage medium or other storage means. A computer readable medium includes, but is not limited to, magnetic and optical storage devices such as disk drives, magnetic tape, CDs (compact discs), DVDs (digital versatile discs), and semiconductor elements such as RAM, DRAM, ROM, EPROM, and Flash memory.

The methods or algorithms described in connection with the examples disclosed herein may be embodied directly in hardware, in a software module executable by a processor, or in a combination of both, in the form of a processing unit, programming instructions, or other directions, and may be contained in a single device or distributed across multiple devices. A software module may reside in RAM memory, Flash memory, ROM memory, EPROM memory, EEPROM memory, registers, a hard disk, a removable disc, a CD-ROM, or any other form of storage medium known in the art. A storage medium may be coupled to the processor such that the processor can read information from, and write information to, the storage medium. In the alternative, the storage medium may be integral to the processor.

It is noted that the drawings and description herein, such as in the subsequent disclosure, may refer to and illustrate signals as a single signal for clarity of presentation and description. It will be understood by a person of ordinary skill in the art that the signal may represent a bus of signals, wherein the bus may have a variety of bit widths and the present disclosure may be implemented on any number of data signals including a single data signal. Furthermore, the signal may be implemented as a physical connection between two elements or a wireless connection between two elements.

In the following description, certain terminology is used to describe certain features of one or more embodiments of the disclosure. For instance, the term "visual display" refers to any display device configured for visually displaying words, symbols, pictures or other indicia. A "remote display device" refers to any device remote from the door system and configured for visually displaying words, symbols, or pictures. A remote display device also includes any device that is readily coupled to and decoupled from the monitoring system such as a portable or hand-held display device. The remote display device may also include a device configured as an input device and capable of providing instructions to other components including, for example, a system controller. A "monitor display" refers to any device installed locally at an automatic door system and which is configured to substantially continuously query a door system controller for the status of the door system. As used herein, "substantially continuously" means that there is no appreciable delay between a change in door status and the status automatically updated to the substantially continuously querying, or requesting, device. For example, the monitor display may automatically query the door system controller for the door system status at least once every second. In some embodiments, the monitor display may automatically query the door system controller for the door system status at least once every ten milliseconds. The monitor display may include a visual display, on which the monitor display shows the substantially continuously updated status of the door system. In such a configuration, the monitor display may be configured to query the door system controller such that there is no appreciable delay between a change in door status and the status automatically displayed on the visual display.

Figure 3:
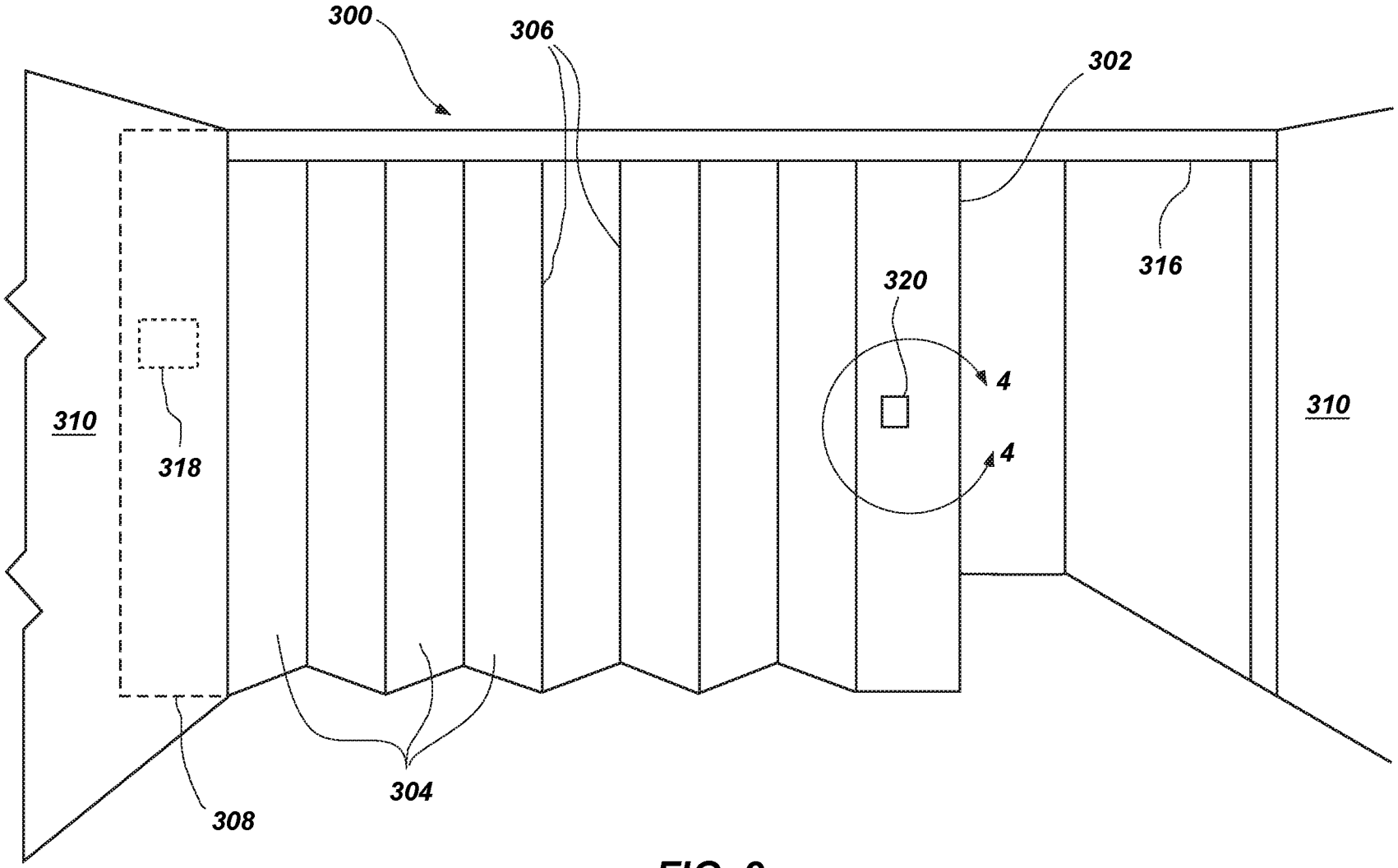
FIG. 3 is an illustration of an automatic door system in accordance with an embodiment of the present disclosure.

Referring to FIG. 3, an automatic door system 300 in accordance with an embodiment of the present disclosure is illustrated. Although automatic door system 300 may comprise a folding door or an accordion-like door 302, the present disclosure may be adapted to various embodiments of automatic door systems and other movable doors or partitions. In some embodiments, a folding door 302 may be used, for example, as a security door, as a fire door, or as any combination thereof. In other embodiments, a folding door 302 may be used simply for subdividing a larger space into smaller rooms or areas. The folding door 302 may be formed with a plurality of panels 304 connected to one another with hinges or other hinge-like structures 306 in an alternating pattern. The hinged connection enables the panels 304 to fold relative to each other in an accordion-like manner enabling the folding door 302 to be retracted or folded and compactly stored in a pocket 308 formed in a wall 310 or other structure. To deploy the folding door 302, an actuator (not shown in FIG. 3), such as, for example, a motor, may drive the folding door 302 along a track 316.

The automatic door system 300 may also include a monitoring system configured for monitoring operational parameters of the automatic door system 300. The monitoring system may include a door system controller 318, a monitor display 320, an optional remote display device, one or more audio transducers (e.g., a speaker), and various input devices, such as sensors and switches (none shown in FIG. 3), each input device configured to sense a characteristic of an operational parameter of the automatic door system 300 and output a signal responsive thereto. For example, input devices as disclosed in U.S. Pat. No. 7,066,297 to Goodman et al., issued Jun. 27, 2006, the disclosure of which is incorporated herein in its entirety by this reference, may be used to sense a characteristic of an operational parameter of the automatic door system 300.

An operational parameter to be monitored by an input device may comprise, for example, a position of the folding door 302. A characteristic of an operational parameter to be sensed by an input device may comprise, for example, a distance from a leading end of the folding door 302 to a wall 310 toward which the folding door 302 extends. A description of a characteristic of an operational parameter to be sensed by an input device may comprise, for example, a message that the folding door 302 is open or closed. In some embodiments, the description of the characteristic of the operational parameter may be encoded. For example, codes, such as identification numbers, may be assigned to each of a set of preselected descriptions of characteristics of operational parameters, and the codes may be transmitted within a network to relay information about an automatic door system 300. Once the code for a particular description of a characteristic of an operational parameter has been received by a device on the network, such as, for example, a monitor display or a remote display device, the description may be decoded and displayed.

As an illustrative, non-limiting example, an operational parameter to be sensed may include a position of a folding door. A sensor may be configured to sense a characteristic of the position of the folding door, such as, for example, a distance between a leading end of the door and a pocket from which the door extends. The sensor may output a signal representing the sensed distance between the leading end of the door and the pocket to a door system controller. The door system controller may then evaluate that distance to determine whether the door is in a retracted state, in an extended state, or somewhere in between. The door system controller may send an identification number corresponding to the determined door position to a display device. The display device may associate the identification number, for example, by referencing a table, with a set of preselected descriptions of the door position, such as, for example, "Door Closed" or "Door Open." That description may then be displayed for a user to see.

The input devices may be used in association with the control of a variety of functions of automatic door system 300 and may be distributed at various locations in and around automatic door system 300. In addition, the input devices may be operatively coupled to a door system controller 318 and configured to output a signal thereto. The signal may comprise the characteristic of the operational parameter, the description thereof, or other information otherwise representative of a characteristic of an operational parameter of an automatic door system. While door system controller 318 is shown located inside the pocket 308, those of ordinary skill in the art will recognize that door system controller 318 may be disposed at a variety of locations relative to folding door 302.

Furthermore, the automatic door system 300 may include a monitor display 320 operatively coupled to the door system controller 318 and configured to receive and display data relating to signals of the input devices as well as other operational data. Although the monitor display 320 is shown positioned on a panel 304 of folding door 302, those of ordinary skill in the art will recognize that the monitor display 320 may be positioned at a variety of locations relative to the folding door 302. For example, the monitor display 320 may be disposed within wall 310 or other structure in which the folding door 302 is located. The monitor display 320 may communicate with the door system controller 318 through any method known in the art, such as, but not limited to, a digital bus, a wireless communication, or fiber optic communication.

Figure 4:
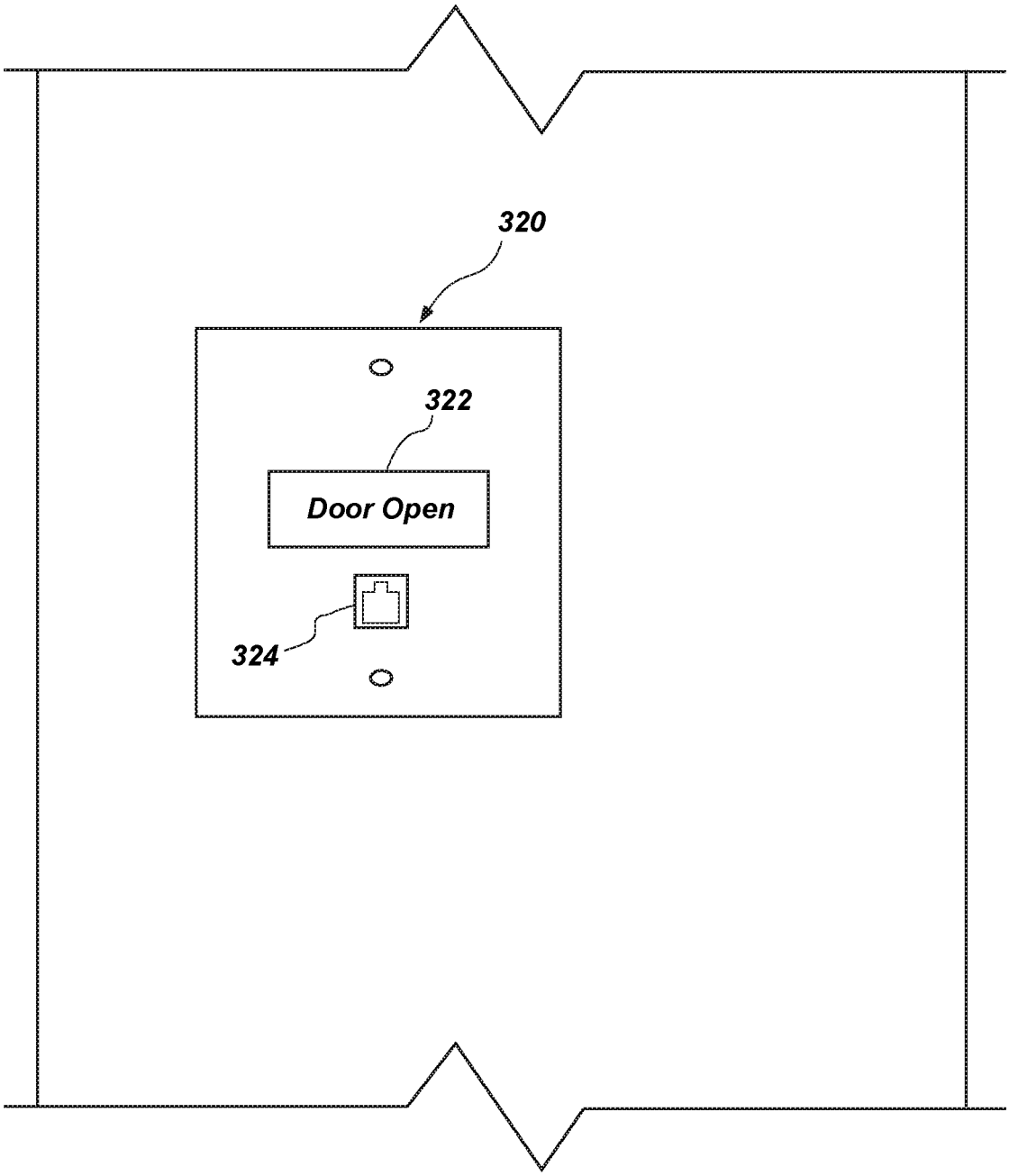
FIG. 4 is a block diagram of a monitor display in accordance with an embodiment of the present disclosure.

Referring now to FIG. 4, an enlarged view of a portion of the monitor display 320 is shown. The monitor display 320 may include a visual display 322 configured to display visual messages to an end-user regarding data relating to the status and operation of various components of automatic door system 300. For example only, and not by limitation, the visual display 322 may comprise an LCD display, an LED display, an OLED display, a CRT display, an LCoS display, or a plasma display. The visual messages may include text messages or other visual indicia describing or indicating an operational parameter characteristic in the form of a fault, alarm, or condition that a component of the automatic door system 300 is experiencing. For example, the visual message may inform the end-user that the folding door 302 is open, a back-up battery has a low voltage, the back-up battery has failed, the AC voltage of a power supply is low, the door path is obstructed, the panic hardware is malfunctioning, a fire or security alarm has been activated, or any other message relevant to a characteristic of the door's operation or status.

The visual display 322 may further display messages to an end-user including instructions as to how to respond to a fault, alarm or other condition reported by the door's monitoring system. For example, in one embodiment, the folding door 302 may include a sensor, whether mechanically, electrically, or optically actuated, that, when actuated, provides an appropriate signal representative of such actuation and indicating that a door path is obstructed. Thus, if the folding door 302 is experiencing a door path obstruction fault, the visual display 322 may provide an end-user with remedial instructions. For example, the visual display 322 may advise the end-user to inspect the door path and, if the door path is clear, to inspect the sensor (or some component thereof). In a more specific example, the sensor may be associated with a displaceable member adjacent the leading edge of the folding door 302. Thus, the visual display 322 may provide instructions regarding maintenance of the displaceable structure. As another example, the visual display 322 may inform the end-user that, if the fault stops after the displaceable member has been placed in its proper operating position, the displaceable structure may be sticking or otherwise malfunctioning and should be inspected, and possibly repaired, by maintenance personnel.

It will be apparent to one of ordinary skill in the art that many variations of operational parameter characteristics, descriptions thereof, faults, alarms, and instructions may be provided through the visual display 322 of the monitor display 320. Therefore, the examples of operational parameter characteristics, descriptions thereof, faults, alarms, and instructions described herein should not be considered to limit the scope of the disclosure.

The monitor display 320 may further include a remote display device interface 324 configured for coupling a remote display device (not shown in FIG. 3) to door system controller 318. The remote display device interface 324 may not communicate directly with the door system controller 318 in the same manner as the monitor display 320. In other words, the monitor display 320 may comprise at least two transceivers, at least a first transceiver for connection to the door system controller 318 and at least another transceiver for connection to the remote display device interface 324. When a remote display device is connected to the remote display device interface 324, the monitor display 320 may independently transmit information obtained from the door system controller 318 to the remote display device. Thus, the remote display device may obtain information about the automatic door system 300 from the monitor display 320, which obtains information about the automatic door system 300 from the door system controller 318. Although the remote display device interface 324 is illustrated as a modular RJ connector, those of ordinary skill in the art will recognize that other suitable communications connectors as known in the art may be used.

Figure 5:
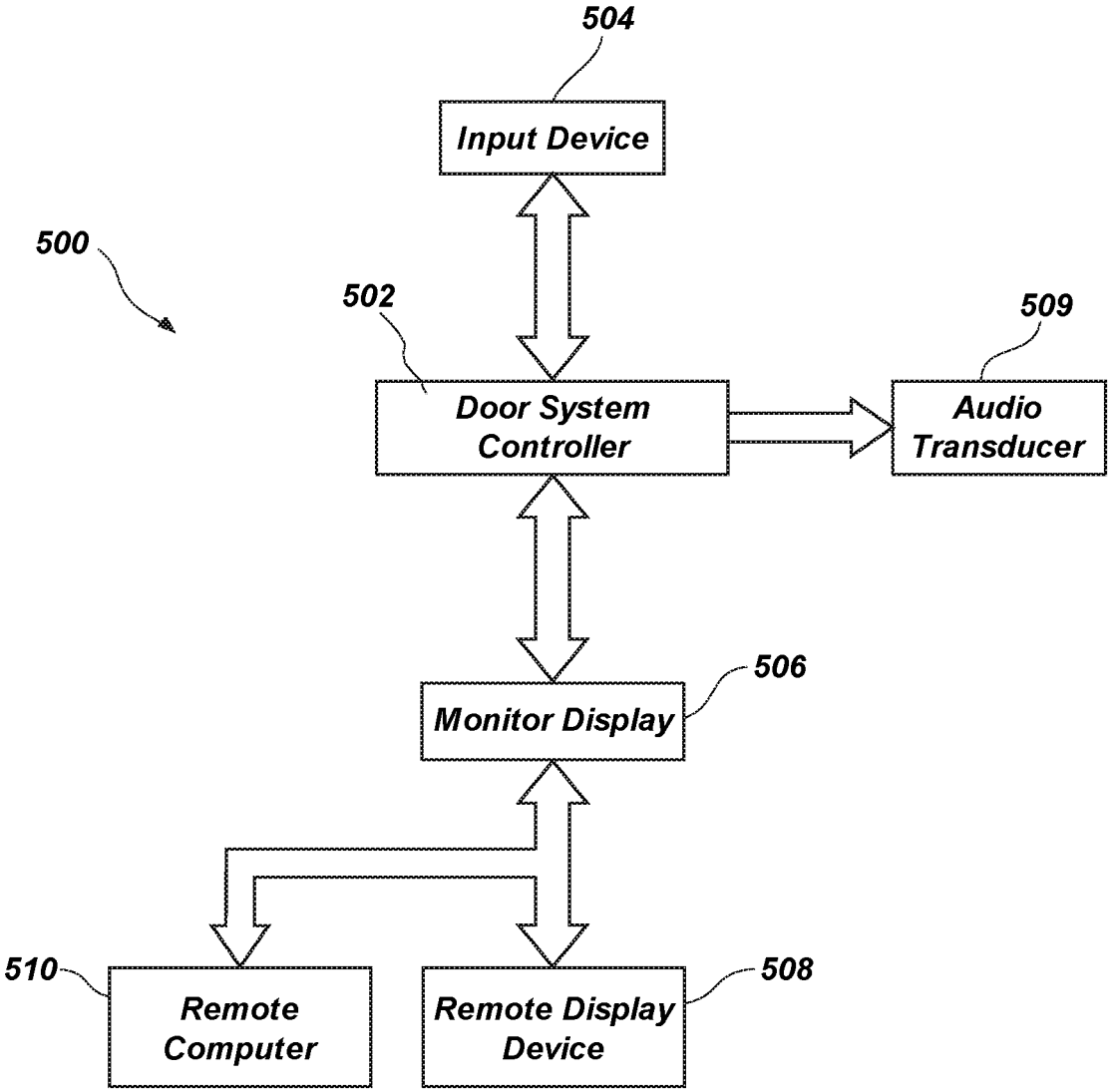
FIG. 5 is a block diagram of a monitoring system according to an embodiment of the present disclosure.

Referring now to FIG. 5, a block diagram is shown illustrating the components of a monitoring system 500 according to one embodiment of the present disclosure. The monitoring system 500 may include a door system controller 502 (which may include, for example, the door system controller 318 described with respect to FIG. 3) configured to send data to, and/or receive data from, one or more input devices 504. The monitoring system 500 may also include a monitor display 506 coupled to the door system controller 502 and configured to request and receive data from the door system controller 502. The monitor display 506 may further include a visual display 322 (see FIG. 4) for displaying messages or indicia representative of data received relating to the operational parameters of folding door 302, such as, for example, a description of a characteristic of an operational parameter. A remote display device 508 may be coupled to the monitor display 506 and configured to request and receive data from the monitor display 506 in a remote location. As described in more detail below, the remote display device 508 may be coupled to a remote computer 510 configured to act as a remote display device interface or at any other remote location where it may be desirable to monitor an automatic door system. In another embodiment, remote display device 508 may be removably coupled to the monitor display 506 and used in relatively close proximity to an associated door.

In addition to transmitting data to the monitor display 506, the door system controller 502 may output audio content to one or more audio transducers 509 (e.g., speakers). Upon receipt of the audio content, the audio transducers 509 may provide audio messages representative of the data sent to the monitor display 506. The audio messages may be similar to the series of beeps as described above, or the audio messages may include pre-recorded verbal messages telling the end-user what fault or alarm may be occurring. A pre-recorded message may further include instructions relating to the fault or alarm similar to the instructions provided in the monitor display as described hereinabove.

Figure 6:
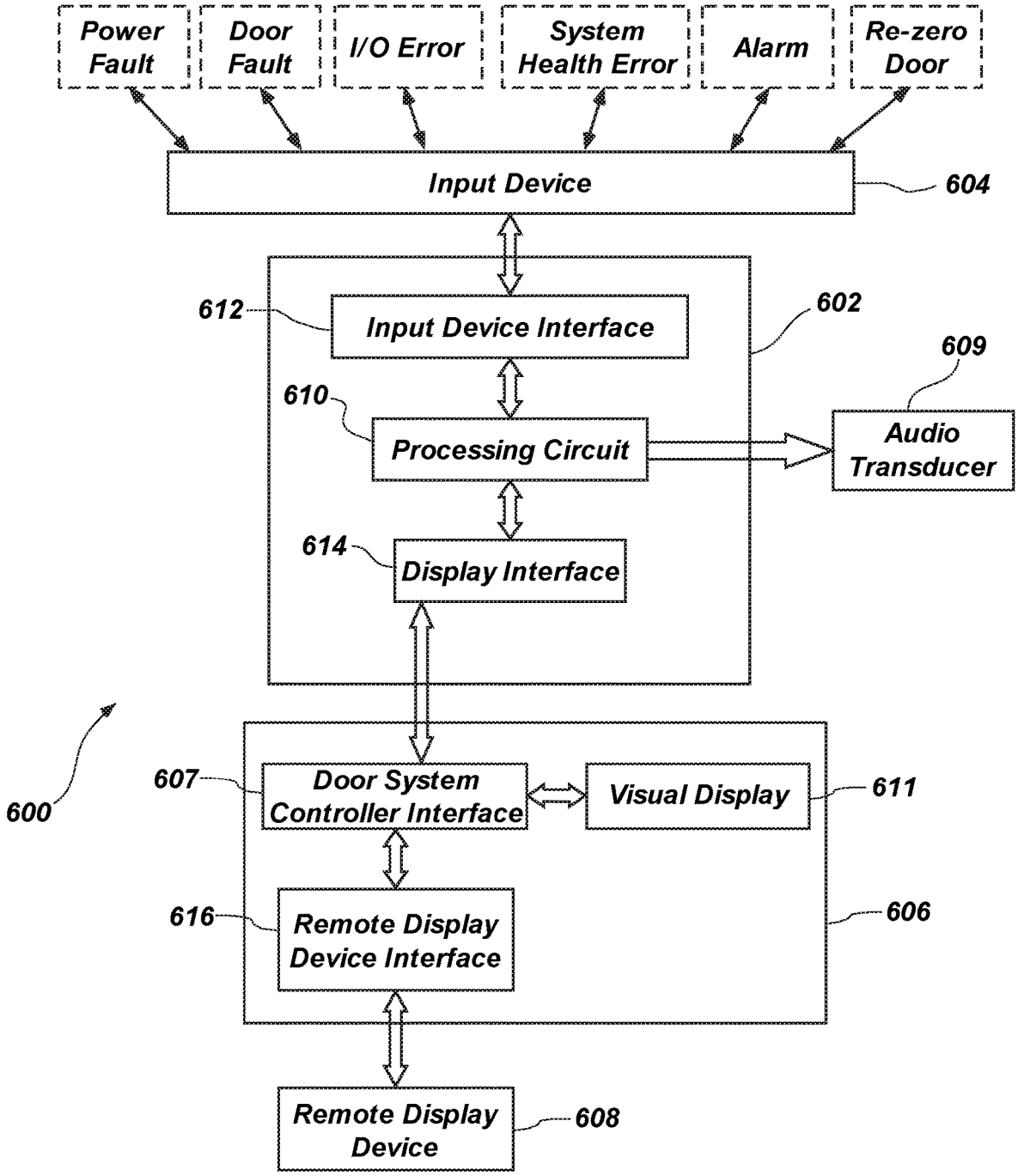
FIG. 6 is a block diagram illustrating a detailed example of a monitoring system according to an embodiment of the present disclosure.

Referring now to FIG. 6, a block diagram illustrating a detailed example of a monitoring system 600 according to one implementation is provided. The monitoring system 600 may include a door system controller 602 comprising a processing or control circuit 610 configured to control the operation of the door system controller 602. The processing circuit 610 may be coupled to an input device interface 612 through which the processing circuit 610 may obtain, process, and/or send monitoring or fault data, such as, for example, a characteristic of an operational parameter or a description thereof, to or from one or more input devices 604. The monitoring or fault data sent from an input device 604 may include, as non-limiting examples, power faults (e.g., back-up battery failure, AC voltage malfunction/failure, fuse failure), door faults (e.g., door is hindered, direction error, drive train failure, pathway obstruction), I/O (input/output) faults (e.g., stuck door block, panic hardware malfunction, limit switch malfunction, key switch malfunction), system health errors (e.g., errors in system memory, ROM, multiplexer (MUX) communication, firmware, or RAM), alarms (e.g., thermal lockout, security violation), and/or re-zero (e.g., calibration) door notices, among others.

The processing circuit 610 may also be coupled to one or more audio transducers 609 (e.g., speakers) and may be configured to provide audio content to the audio transducers 609 relating to the monitoring or fault data received from an input device 604. As discussed above, the audio content may include multiple distinct patterns of beeps, which are representative of individual monitor or fault events. As previously noted, in some embodiments the audio content may also include pre-recorded messages describing a given monitor or fault event and/or providing end-user instructions.

The processing circuit 610 may also be coupled to a display interface 614 through which the processing circuit 610 may obtain, process, and/or send monitoring or fault data to a door system controller interface 607 of a monitor display 606. The door system controller interface 607 may comprise, for example, a transceiver. The monitor display 606 may be configured to display visual information regarding a description of a characteristic of an operational parameter, such as, for example, a status condition, a fault, or an alarm experienced by the automatic door system 300 (see FIG. 3), to an end-user using a visual display 611. The monitor display 606 may include a remote display device interface 616 to which a remote display device 608, such as a computer, hand-held device, or other input or output device may be coupled.

The monitor display 606 and the remote display device interface 616 may not share a common transmission pathway to the door system controller 602. Thus, the monitor display 606 may substantially continuously query the door system controller 602 and update information displayed on the visual display 611, enabling an end-user to receive current status information about an automatic door system 300 (see FIG. 3) from the monitor display 606. For example, the monitor display 606 may update the status of the automatic door system 300 (see FIG. 3) at least once every second. In another example, the monitor display 606 may query the door system controller 602 for the status of the automatic door system 300 (see FIG. 3) at least once every ten milliseconds. The monitor display 606 may be configured to query the door system controller 602 such that there is no appreciable delay between a change in door status and the status displayed on the visual display 611.

In some embodiments, the remote display device 608 may intermittently query the monitor display 606, enabling an end-user to receive intermittently updated status information about an automatic door system 300 (see FIG. 3) from the remote display device 608. As used herein, "intermittently" means that there may be an appreciable delay between a change in door status and the status stored or displayed automatically by the intermittently querying or requesting device, or that user input may be required for the status to be manually updated without appreciable delay. For example, a remote display device 608 connected to a network of automatic door systems 300 (see FIG. 3) may query the monitor display 606 associated with each automatic door system 300 in succession, the status of each automatic door system 300 being sent to the remote display device 608 once per round of queries and there being at least some delay between queries sent to any particular door system 300 as the remote display device 608 queries other automatic door systems 300 on the network. For example, the remote display device 608 may automatically query a monitor display 606 once every minute. In another example, the remote display device 608 may automatically query a monitor display 606 once every five minutes. In some embodiments, the remote display device 608 may be configured intermittently to query the monitor display 606 in response to a user input.

In addition, the monitor display 606 may be the only device configured to communicate directly with the processing circuit 610 of the door system controller 602, enabling a simple process hierarchy. Specifically, the door system controller 602 may always operate in a slave mode with respect to the monitor display 606. The monitor display 606 may also operate in a slave mode with respect to a remote display device 608, when a remote display device 608 is operatively coupled to the remote display device interface 616 or otherwise connected to the monitor display 606, such as, for example, by a network communication line. In computer networking, a master/slave configuration is a model for a communication protocol in which one device or process (known as the master) controls one or more other devices or processes (known as slaves). Once the master/slave relationship is established, the direction of control is always from the master to the slave(s). The slave(s) do not communicate with the processor without the master first giving permission to the slave(s) to communicate. Thus, the monitor display 606 operates as both a master with respect to the door system controller 602 and a slave with respect to the remote display device 608, serving to obtain and optionally display substantially continuously updated information from the door system controller 602 and send intermittently requested information to the remote display device 608.

Figure 7:
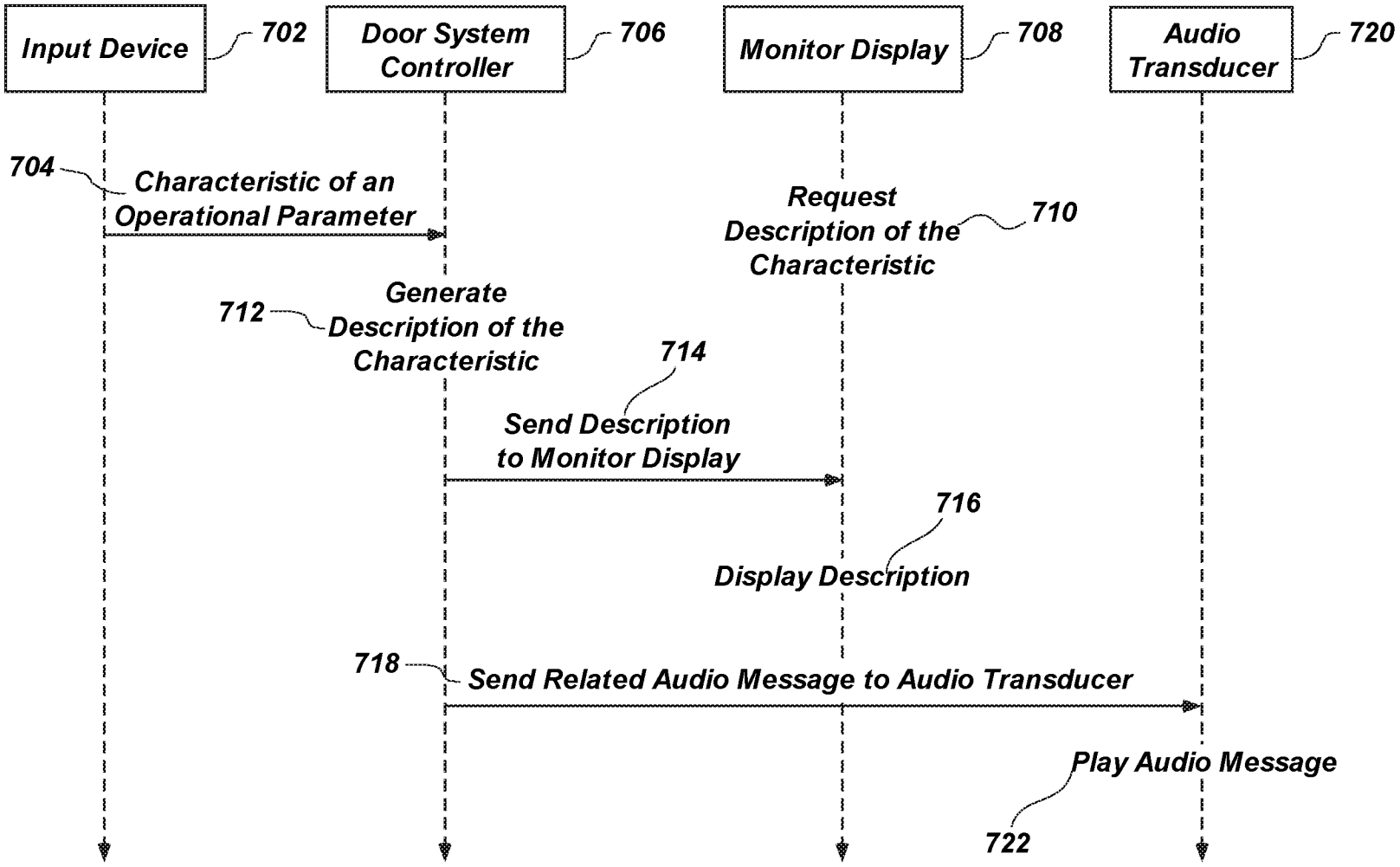
FIG. 7 is a flow diagram illustrating the flow of information during operation of a monitoring system according to an embodiment of the present disclosure.

FIG. 7 illustrates the flow of information during operation of a monitoring system according to an embodiment of the disclosure. An input device 702 may sense a characteristic of an operational parameter of an automatic door system and may send the characteristic of an operational parameter 704 to a door system controller 706. The sensed characteristic of an operational parameter may comprise, for example, a distance from a leading end of a folding door to a wall toward which the folding door extends, whether an alarm has been tripped, whether a component of the automatic door system is operational, a temperature proximate the automatic door system, or any other quantitative measure of an operational parameter of an automatic door system. A monitor display 708 may initiate retrieval of a description of the characteristic 710. Because the monitor display 708 initiates retrieval of the description, the monitor display 708 is operating in a master mode with respect to the door system controller 706. The door system controller 706 may then generate the description of the characteristic of an operational parameter 712 and send the description 714 to the monitor display 708 where the description or a message related to the description is displayed 716. In other embodiments, the door system controller may generate an encoded description of the characteristic of an operational parameter and send the encoded description to the monitor display where the description is decoded and displayed. In another embodiment, the input device 702 may both sense the characteristic of the operational parameter of the automatic door system and generate the description of the characteristic, either in encoded form or not, which description may then be sent to the door system controller 706, and from the door system controller 706 to the monitor display 708. In still another embodiment, both the characteristic and the description thereof may be sent to the monitor display 708. The description may comprise, for example, whether the folding door is open or closed, which alarm has been tripped, which component of the automatic door system is malfunctioning, whether an emergency event such as a fire or security emergency has occurred, or simply a status update of one or more components of the automatic door system. The door system controller 706 may also send an audio message related to the description 718 to an audio transducer 720 where the audio message is played 722.

Figure 8:
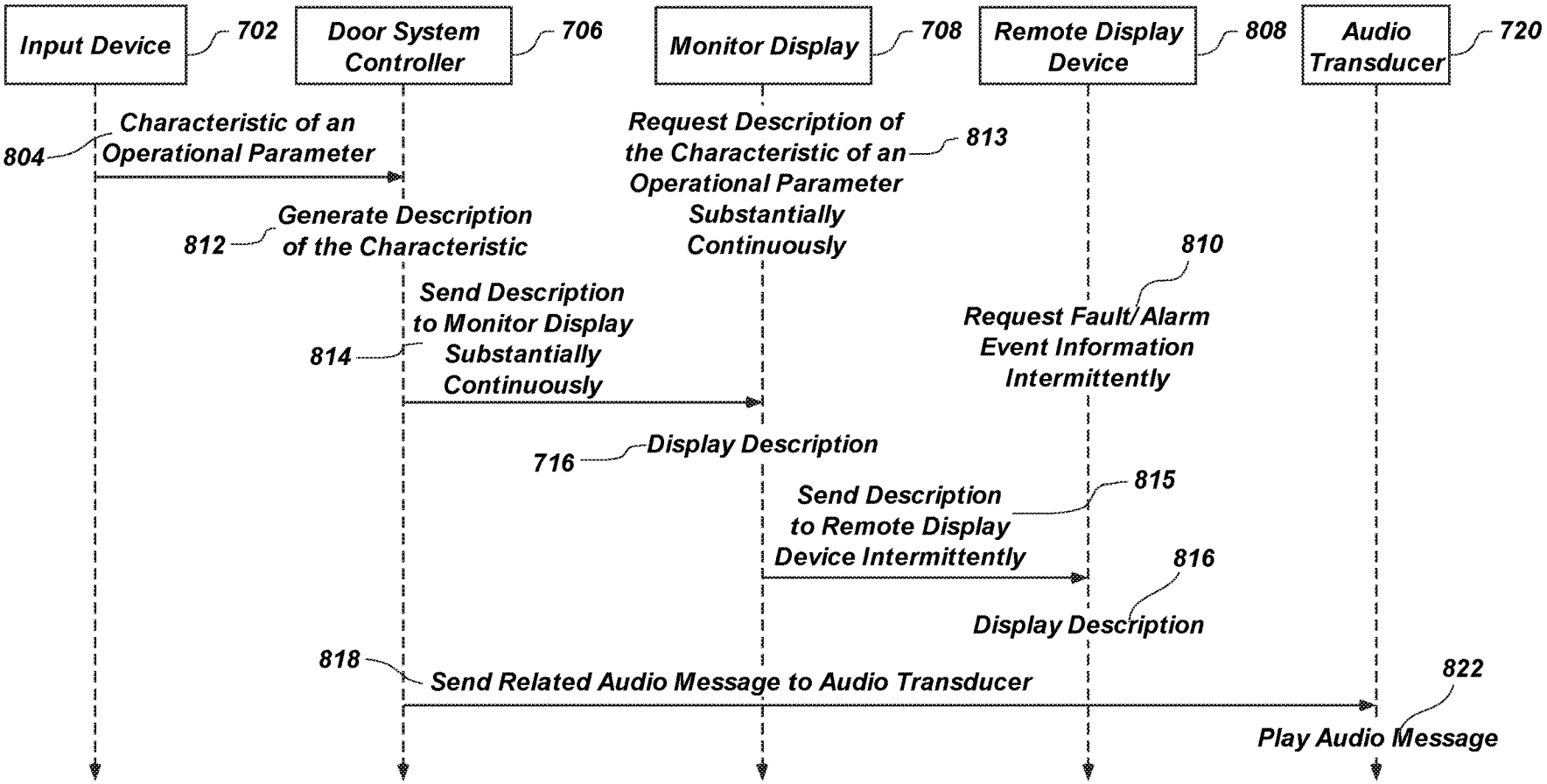
FIG. 8 is a diagram illustrating the flow of information during operation of a monitoring system having a remote display device in accordance with an embodiment of the present disclosure.

FIG. 8 illustrates a flow of information during operation of a monitoring system that includes a remote display device 808 according to an embodiment of the disclosure. An input device 702 may sense a characteristic of an operational parameter 804 of an automatic door system and send the characteristic of an operational parameter 804 to the door system controller 706. A monitor display 708 may substantially continuously initiate retrieval of a description of the characteristic 813. Because the monitor display 708 substantially continuously initiates retrieval of the description of the characteristic 813, the monitor display 708 is always operating in a master mode configuration with respect to the door system controller 706. The door system controller 706 may then generate the description of the characteristic of an operational parameter 812 and send the description 814 to the monitor display 708 where the description or a message related to the description is displayed 716. In other embodiments, the door system controller may generate an encoded description of the characteristic of an operational parameter and send the encoded description to the monitor display where the description is decoded and displayed. In another embodiment, the input device 702 may both sense the characteristic of the operational parameter of the automatic door system and generate the description of the characteristic, either in encoded form or not, which description may then be sent to the door system controller 706, and from the door system controller 706 to the monitor display 708. A remote display device 808 may intermittently request the description 810 from the monitor display 708 because the remote display device 808 is not directly coupled to the door system controller 706. Because the remote display device 808 intermittently initiates retrieval of the description 810, the remote display device 808 is always operating in a master mode configuration with respect to the monitor display 708. The monitor display 708 may then send the description 815 to the remote display device 808 where the description is displayed 816. In another embodiment, both the characteristic and the description of the characteristic may be sent to the monitor display 708 and, optionally, to the remote display device 808. As discussed with respect to other embodiments described herein, the door system controller 706 may also send an audio message related to the description 818 to an audio transducer 720 where the audio message is played 822.

Figure 9:
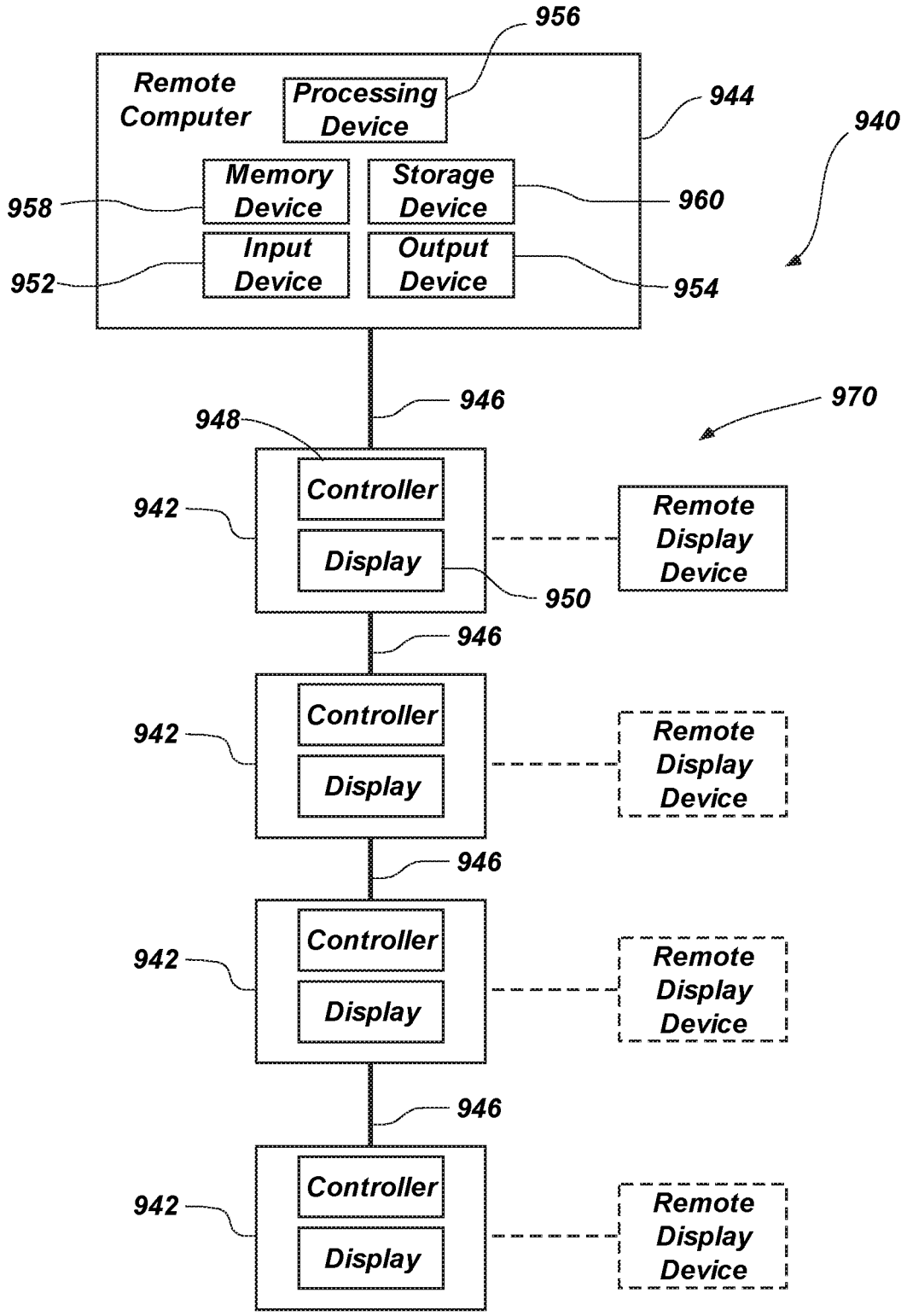
FIG. 9 is a block diagram of a network of automatic door systems according to an embodiment of the present disclosure.

FIG. 9 illustrates an embodiment of the disclosure comprising an automatic door network 940 according to an embodiment of the present disclosure. The automatic door network 940 may include one or more automatic door systems 942 and a remote computer 944 operatively coupled to each automatic door system 942 through a communication line 946. The remote computer 944 may include, for example, one or more input devices 952 (e.g., keyboard, mouse, touch pads), output devices 954 (e.g., displays, printers), processing devices 956 (e.g., a central processing unit), memory devices 958 (e.g., random access memory, read only memory) data storage devices 960 (e.g., hard drives, solid state drives, DVDs, CDs) and may be configured to read and execute software associated with the operation of one or more automatic door systems 942.

At least one automatic door system 942 within the automatic door network 940 may include a door system controller 948 and a monitor display 950, which may include a visual display. The door system controller 948 may comprise a door system controller (e.g., 318, 502, 602, or 706) as described in connection with FIGS. 3 through 8. Moreover, the monitor display 950 may comprise a monitor display (e.g., 320, 506, 606, or 708) as described with reference to FIGS. 3 through 8.

At least one automatic door system 942 within the automatic door network 940 may be assigned a communication line address. As a non-limiting example, up to eight communication lines 946 may be coupled with the remote computer (although only a single communication line 946 is shown in FIG. 9), and each communication line 946 may include up to thirty-two separately addressed automatic door systems 942.

Each monitor display 950 may be configured to operate as a master device with respect to an associated door system controller 948 and may substantially continuously request information from the associated door system controller 948. The remote computer 944 may be configured to operate as a master device with respect to the monitor display 950 of each automatic door system 942 and may intermittently communicate with, and request information from, each monitor display 950 on a communication line 946 by transmitting a specific door address along with a command and/or an instruction. Although each monitor display 950 on the communication line 946 may receive and decode all information transmitted from the remote computer 944, only a specified monitor display having a matching automatic door system address may respond and/or react to the transmitted request.

A remote display device 970 (which may include, for example, a remote display device 508, 608, or 808 as has been described with respect to FIGS. 5, 6, and 8) may also be selectively and removably coupled to each monitor display 950. Each monitor display 950 may be configured to operate in a slave mode with respect to a remote display device 970 so connected while remaining in a master mode with respect to a respective door system controller 948 to which the monitor display 950 is connected. Thus, both the remote computer 944 and a remote display device 970 may intermittently receive status updates from a monitor display 950 in the automatic door network 940, while the monitor display 950 substantially continuously receives status updates from its associated door system controller 948.

While operating, each monitor display 950 may receive instructions and/or status requests from the remote computer 944. Upon receipt of an instruction and/or request, a monitor display 950 may transmit the instruction to the door system controller 948 and/or transmit information to remote computer 944. Thereafter, the information may be displayed using the output device 954. If a master device, such as remote computer 944 is disconnected or loses communication with the automatic door network 940, each door system's 942 monitor display 950 may continue to operate in master mode with respect to its respective door system controller 948 and substantially continuously receive and optionally display information or instructions relating to the corresponding automatic door system 942 within the local monitor display 950 such as has been described above.

A contemplated operation of the automatic door network 940 including a remote computer 944 will now be described. At any time during operation, the remote computer 944 may send instructions and/or a status request along with an address on a communication line 946. After sending the request, the remote computer 944 may release the communication line and wait for a response from a specified automatic door system 942. Each monitor display 950 coupled to the communication line 946 may receive the request, but only a monitor display 950 of an automatic door system 942 having a matching address may respond to the request. Upon receiving a request with a matching address, a corresponding monitor display 950 may transmit information to the remote computer 944. Thereafter, the monitor display 950 may release the communication line 946, permitting the remote computer 944 to provide instruction to and/or request information from another automatic door system 942 on the communication line 946. Information transmitted to the remote computer 944 may include, but is not limited to, characteristics of operational parameters and descriptions thereof as have been described above. Upon receiving information from a monitor display 950, the remote computer 944 may display the transmitted information via an appropriate output device 954. Furthermore, the information regarding an automatic door system 942 may also be displayed in its corresponding monitor display 950. The status information may be more current on the monitor display 950 because the monitor display 950 substantially continuously requests updated information from its corresponding door system controller 948. The information that the monitor display 950 sends to the remote computer 944 may be the most recently received update from the door system controller 948.

In an embodiment where the automatic door network 940 includes neither a remote computer 944 nor a communication line 946 (or in the situation where communication has been lost or terminated between a remote computer 944 and door system controllers 948), each door system's monitor display 950 may continue operating as a master device with regard to its associated door system controller 948. While operating as a master device, each monitor display 950 may query its corresponding door system controller 948 substantially continuously for information, such as, for example, characteristics of operational parameters and descriptions thereof, enabling each automatic door system 942 to function independently of the automatic door network 940. Upon receipt of information, the monitor display 950 may update the information shown on its visual display substantially continuously.

As noted above, the automatic door network 940 may include one or more remote display devices 970. The remote display device(s) 970 may comprise a programmer/emulator/tester (PET) device operatively coupled to a single monitor display 950 of an automatic door system 942. Such a PET device may be used, for example, by an installer or maintenance personnel to program the automatic door system 942, to emulate certain situations the automatic door system 942 may encounter during operation, and to test the automatic door system 942.

As previously discussed, the remote display device 970 may operate as a master device with respect to the door system's monitor display 950, which continues to operate as a master with respect to the uniquely addressed door system controller 948 and sends substantially continuous update requests to the door system controller 948. When the monitor displays 950 are coupled to a common communication line 946, the remote display device 970 may, by specifying an address of a given automatic door system 942, become the master of any monitor display 950 on the line 946. Thus, each automatic door system 942 on the common communication line 946 may be programmed by the remote display device 970. Furthermore, the remote display device 970 may request information from the monitor display 950 of each automatic door system 942 using a process similar to the process employed by the remote computer 944 described above. When a remote display device 970 transmits control information to, or requests information from, a specified automatic door system 942, all monitor displays 950 of each automatic door system 942 within the automatic door may receive and decode the information on communication line 946, but only a monitor display 950 of an automatic door system 942 with a matching address will respond and/or react to the request.

While the present disclosure has been described herein with respect to certain embodiments, those of ordinary skill in the art will recognize and appreciate that it is not so limited. Rather, many additions, deletions, and modifications to the embodiments described herein may be made without departing from the scope of the disclosure as hereinafter claimed, including legal equivalents. In addition, features from one embodiment may be combined with features of another embodiment while still being encompassed within the scope of the disclosure as contemplated by the inventors.

What is claimed is:

1. A network of automatic door systems, comprising:

at least one communication line;

a remote computer operatively coupled to the at least one communication line and configured to operate as a remote display device interface, wherein the remote computer comprises at least one remote display device; and a plurality of automatic door systems operatively coupled to the at least one communication line, at least one automatic door system of the plurality of automatic door systems comprising:

at least one input device configured to determine at least one characteristic of at least one operational parameter of the at least one automatic door system and output a signal in response thereto;

a door system controller operatively coupled to the at least one input device and configured to request and receive the signal from the at least one input device; and at least one monitor display operatively coupled to the door system controller and the at least one communication line and configured to request information representative of the at least one operational parameter characteristic from the door system controller substantially continuously and display the information, the at least one monitor display comprising a first interface operatively coupled to the door system controller and at least another interface operatively coupled to the at least one communication line, wherein the remote computer is further configured to request the information representative of the at least one operational parameter characteristic of the at least one automatic door system intermittently from the at least one monitor display of the at least one automatic door system and the at least one remote display device is configured to display indicia of the information representative of the at least one operational parameter characteristic of the at least one automatic door system.

2. The network of automatic door systems of claim 1, wherein the remote computer is further configured to request the information representative of the at least one operational parameter characteristic of the at least one automatic door system intermittently from the at least one monitor display of the at least one automatic door system.

3. A method of monitoring a plurality of automatic door systems, comprising:

determining at least one operational parameter characteristic of a respective automatic door system of the plurality of automatic door systems utilizing at least one input device;

transmitting a signal representative of the at least one operational parameter characteristic from at least one input device to a door system controller;

sending a description of the at least one operational parameter characteristic from the door system controller to at least one monitor display operatively coupled to the respective automatic door system via a first interface substantially continuously in response to substantially continuous requests from the at least one monitor display;

sending a description of the at least one operational parameter characteristic from the at least one monitor display to a remote display device of a remote computer operatively coupled to the at least one monitor display utilizing a communication line to which the plurality of automatic door systems and the remote computer via at least another interface in response to intermittent requests from the remote computer; and displaying indicia representative of the description of the at least one operational parameter characteristic on the at least one monitor display and the remote display device.

4. The method of monitoring an automatic door system of claim 3, wherein sending the description of the at least one operational parameter characteristic from the door system controller to the at least one monitor display substantially continuously comprises sending the description of the at least one operational parameter from the door system controller to the at least one monitor display at least once per second.

5. The method of monitoring an automatic door system of claim 4, wherein sending the description of the at least one operational parameter characteristic from the door system controller to the at least one monitor display substantially continuously comprises sending the description of the at least one operational parameter from the door system controller to the at least one monitor display at least once every ten milliseconds.

6. The method of monitoring an automatic door system of claim 3, wherein sending the description of the at least one operational parameter characteristic from the at least one monitor display to the remote display device in response to the intermittent requests from the remote computer comprises sending the description of the at least one operational parameter characteristic from the at least one monitor display to the remote display device once per round of queries from the remote computer to each automatic door system of the plurality of automatic door systems.

7. A method of installing a monitoring system for a network of automatic door systems, comprising:

establishing a communication line among a plurality of automatic door systems and a remote computer;

coupling at least one input device configured for determining at least one characteristic of at least one operational parameter of at least one automatic door system and output a signal in response thereto to at least one input device interface of a door system controller configured to receive the signal;

coupling at least one monitor display configured to request data representative of the at least one operational parameter characteristic from the door system controller substantially continuously and display the data to the door system controller via a first interface and to the communication line via at least another interface; and coupling at least one remote display device of the remote computer configured to intermittently request the data representative of the at least one operational parameter characteristic from the at least one monitor display to the communication line and display indicia of information representative of the at least one operational parameter characteristic of the at least one automatic door system.

8. The method of installing a monitoring system for a network of automatic door systems of claim 7, wherein coupling at least one monitor display configured to request data representative of the at least one operational parameter characteristic from the door system controller substantially continuously to the door system controller and to the communication line comprises coupling at least one monitor display configured to request data representative of the at least one operational parameter characteristic from the door system controller at least once every second to the door system controller and to the communication line.

9. The method of installing a monitoring system for a network of automatic door systems of claim 7, wherein coupling at least one monitor display configured to request data representative of the at least one operational parameter characteristic from the door system controller substantially continuously to the door system controller and to the communication line comprises coupling at least one monitor display configured to request data representative of the at least one operational parameter characteristic from the door system controller at least once every ten milliseconds to the door system controller and to the communication line.

10. The method of installing a monitoring system for a network of automatic door systems of claim 7, wherein coupling at least one remote display device configured to intermittently request the data representative of the at least one operational parameter characteristic from the at least one monitor display to the communication line comprises coupling at least one remote display device configured to request data representative of the at least one operational parameter characteristic from the at least one monitor display from each other monitor display coupled to the communication line before requesting data representative of the at least one operational parameter characteristic from the at least one monitor display a second time.

11. A method of monitoring a network of automatic door systems, comprising:

determining at least one operational parameter characteristic of a first automatic door system of a plurality of automatic door systems utilizing at least one input device;

sending substantially continuous requests to update at least one operational parameter characteristic from a door system controller of the first automatic door system to at least one monitor display of the first automatic door system;

transmitting a signal representative of the at least one operational parameter characteristic from at least one input device to the door system controller;

sending a description of the at least one operational parameter characteristic from the door system controller to the at least one monitor display via a first interface substantially continuously;

sending intermittent requests to update the at least one operational parameter characteristic from a remote computer to the at least one monitor display of the first automatic door system utilizing a communication line to which the remote computer and the plurality of automatic door systems are connected;

sending a description of the at least one operational parameter characteristic from the at least one monitor display to a remote display device of the remote computer operatively coupled to the at least one monitor display via at least another interface in response to the request to update the at least one operational parameter characteristic; and displaying indicia representative of the description of the at least one operational parameter characteristic on the at least one monitor display and the remote display device.

12. The method of claim 11, wherein sending the description of the at least one operational parameter characteristic from the door system controller to the at least one monitor display substantially continuously comprises sending the description of the at least one operational parameter from the door system controller to the at least one monitor display at least once per second.

13. The method of claim 12, wherein sending the description of the at least one operational parameter characteristic from the door system controller to the at least one monitor display substantially continuously comprises sending the description of the at least one operational parameter from the door system controller to the at least one monitor display at least once every ten milliseconds.

14. The method of claim 11, wherein sending the description of the at least one operational parameter characteristic from the at least one monitor display to the remote display device comprises sending the description of the at least one operational parameter characteristic from the at least one monitor display to the remote display device at most once per minute.

15. The method of claim 11, further comprising sending end-user instructions relating to the at least one operational parameter characteristic of the first automatic door system from the door system controller to the at least one monitor display.

16. The method of claim 11, wherein transmitting the signal representative of the at least one operational parameter characteristic comprises transmitting the signal representative of at least one of a system fault, a component status, and an alarm.

17. The method of claim 11, wherein transmitting the signal representative of the at least one operational parameter characteristic from the at least one input device comprises transmitting the signal representative of the at least one operational parameter characteristic from at least one of a sensor and a switch.

18. The method of claim 11, wherein displaying the indicia representative of the description of the at least one operational parameter characteristic on the at least one monitor display comprises displaying the indicia representative of the description of the at least one operational parameter characteristic on the at least one monitor display installed locally on a portion of the first automatic door system.

19. The method of claim 11, wherein displaying the indicia representative of the description of the at least one operational parameter characteristic on the at least one monitor display comprises displaying the indicia representative of the description of the at least one operational parameter characteristic on the at least one monitor display installed locally on a wall located adjacent a portion of at least one automatic door.

* * * * *